US007438558B1

(12) United States Patent
Sinha

(10) Patent No.: US 7,438,558 B1
(45) Date of Patent: Oct. 21, 2008

(54) THREE-DIMENSIONAL STACKABLE DIE CONFIGURATION FOR AN ELECTRONIC CIRCUIT BOARD

(75) Inventor: Arvind Kumar Sinha, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/939,272

(22) Filed: Nov. 13, 2007

(51) Int. Cl.
*H01R 12/00* (2006.01)

(52) U.S. Cl. ..... 439/65; 439/77; 439/67

(58) Field of Classification Search ..... 439/65–67, 439/70, 71, 73, 330, 206, 485
See application file for complete search history.

(56) References Cited

U.S. PATENT DOCUMENTS 5,850,693 A * 12/1998 Guran et al. ..... 29/884
5,935,687 A 8/1999 Davidson et al.
6,036,502 A * 3/2000 Neidich et al. ..... 439/67
6,354,844 B1 * 3/2002 Coico et al. ..... 439/66
6,435,883 B1 8/2002 Warren
6,590,159 B2 * 7/2003 Fan et al. ..... 174/541
6,903,941 B2 * 6/2005 Paola ..... 361/803
2003/0020151 A1 1/2003 Chen

* cited by examiner

*Primary Examiner*—Tho D. Ta
*Assistant Examiner*—Travis Chambers
(74) *Attorney, Agent, or Firm*—Cantor Colburn LLP

(57) ABSTRACT

A three-dimensional die configuration for mounting electronic components to a circuit board includes a circuit board having at least one circuit board die, a first electronic component mounted at the circuit board die and a first substrate member including a first surface electrically connected to the first chip. The three-dimensional die configuration further includes a double-sided land grid array having a first surface electrically connected to a second surface of the first substrate member. A second substrate member is electrically connected to a second surface of the double-sided land grid array. A second electronic component is electrically connected to a second surface of the second substrate member. A thermal interface member abuts the second chip and is covered by a cap member. The resulting three-dimensional die configuration establishes a multiple electronic component mounting arrangement having a footprint of a single electronic component.

5 Claims, 1 Drawing Sheet

THREE-DIMENSIONAL STACKABLE DIE CONFIGURATION FOR AN ELECTRONIC CIRCUIT BOARD

BACKGROUND OF THE INVENTION

1. Field of the Invention

This invention relates to electronic component mounting and, more particularly, to a three-dimensional stackable die configuration for mounting electronic components to a circuit board.

2. Description of Background

Electronic components are mounted to circuit boards or other substrates using a variety of connector schemes. Conventionally, a pin grid array (PGA) interface was used to mount a processor to a processor socket on a printed circuit board. A pin grid array includes a number of pins, typically on the processor, that mate with corresponding pin acceptors on the processor socket. More recently, ball grid array (BGA) and land grid array (LGA) interfaces are used to connect processors to circuit boards. Unlike the PGA interface a chip mounted with a BGA or LGA interface does include pins. In place of pins, the chip is provided with gold or copper plated balls/pads that touch pins on the circuit board. The BGA and LGA interface provides a larger contact point that allows a processor to run at higher clock frequencies and also provides a more stable power connection. However, while BGA and LGA interfaces allow for higher clock speeds and provide more efficient power connections, the contact balls/pads require more surface area than, for example, pins. Open space on a printed circuit board is at a premium. As electrical devices shrink in size, free space for additional electronic components is rapidly decreasing.

SUMMARY OF THE INVENTION

The shortcomings of the prior art are overcome and additional advantages are provided through the provision of a three-dimensional die configuration for mounting electronic components to a circuit board. The three-dimensional die configuration includes a circuit board having at least one circuit board die, a first electronic component mounted at the circuit board die, a first substrate member including a first surface electrically connected to the electronic component, and a second surface. The three-dimensional die configuration further includes a double-sided land grid array having a first surface electrically connected to the second surface of the first substrate member, and a second surface. A second substrate member includes a first surface electrically connected to the second surface of the double-sided land grid array. A second electronic component is electrically connected to a second surface of the second substrate member. In addition, the three-dimensional die configuration includes a thermal interface member that abuts the second electronic component. The thermal interface member is covered by a cap member that is mounted to the second electronic component and the thermal interface member. The resulting three-dimensional die configuration establishes a multiple electronic component mounting arrangement that occupies a footprint previously reserved for a single electronic component.

Additional features and advantages are realized through the techniques of exemplary embodiments of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawings in which:

Figure 1:
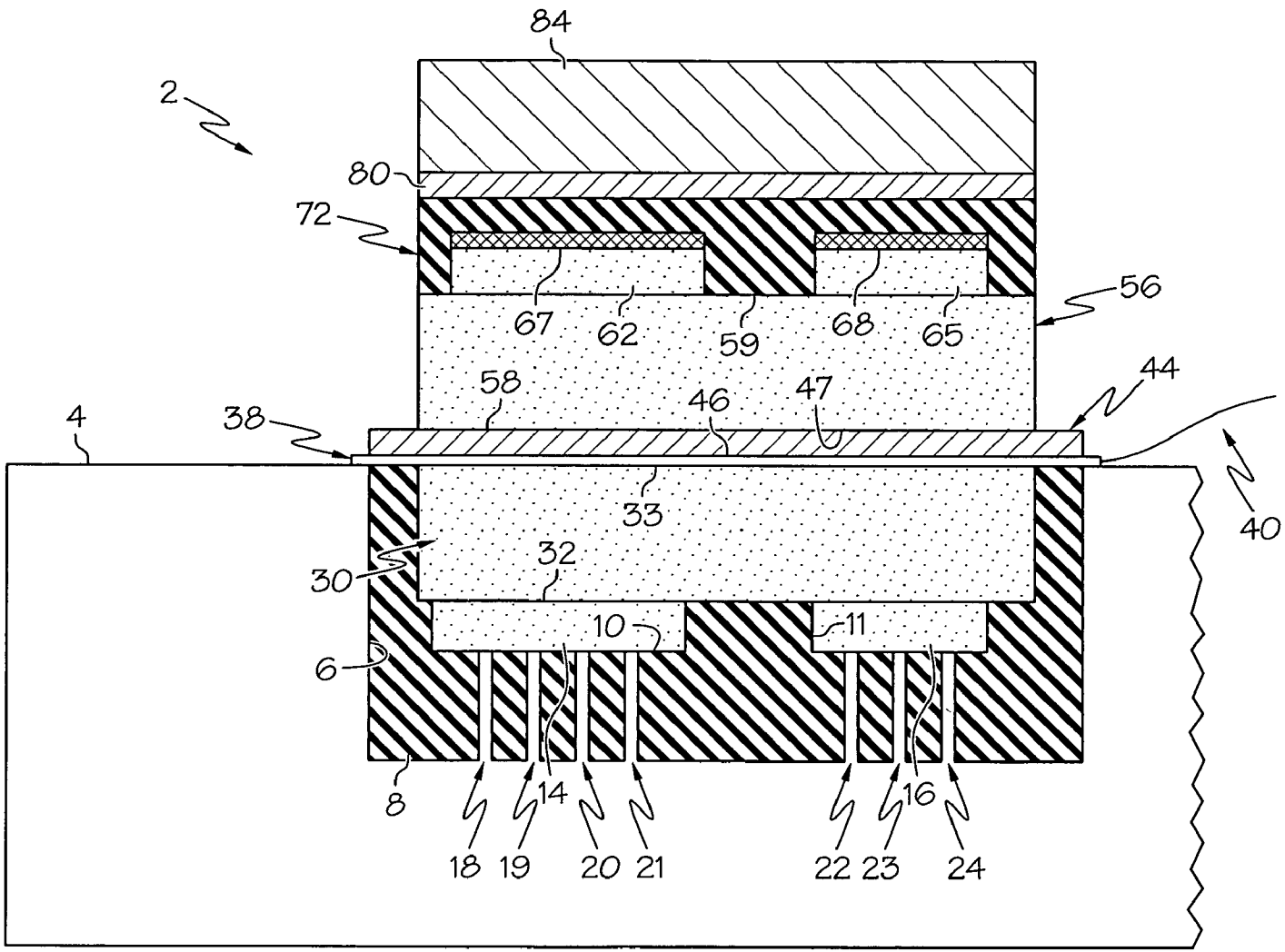
FIG. 1 illustrates one example of a three-dimensional stackable die configuration for an electronic circuit board constructed in accordance with an exemplary embodiment of the present invention.

The detailed description explains the preferred embodiments of the invention, together with advantages and features, by way of example with reference to the drawing.

DETAILED DESCRIPTION OF THE INVENTION

Turning now to the drawings in greater detail, it will be seen that in FIG. 1 there is shown a three-dimensional stackable die configuration 2 constructed in accordance with an exemplary embodiment of the present invention. Die configuration 2 includes the circuit board 4 having a cavity 6 filled with a thermal insulator or interface material 8. In accordance with the embodiment shown, thermal interface material 8 forms first and second board dies 10 and 11 within which are arranged first and second electronic components or chips 14 and 16 respectively. In further accordance with the exemplary embodiment shown, first and second electronic components 14 and 16 are low power electronic chips having a power output of about 50 watts or more. Heat generated by operation of first and second electronic components 14 and 16 is readily dissipated through thermal interface material 8 as well as a plurality of vias 18-24 formed in circuit board 4. That is, vias 18-24 establish a heat dissipation path for first and second electronic components 14 and 16.

First and second electronic components 14 and 16 are electrically connected to a first substrate member 30 having a first surface 32 and an opposing, second surface 33. First substrate member 30 is formed from an organic material such as, for example, a ceramic or polyamide layer and provides an electrical interface with a flex cable 38. Flex cable 38 includes a cable and having a plurality of conductors, that provide input and output I/O interface for first and second electronic components 14 and 16 as well as an additional electronic components as will described more fully below. In any event, flex cable 38 is electrically coupled to a double-sided land grid array 44 having a first surface 46 and an opposing, second surface 47. Land grid array 44 serves as an interface to a second substrate member 56 having first and second surfaces 58 and 59. In a manner similar to that described above, second substrate member 56 is formed from an organic material such as ceramic or a polyamide layer. Double-sided land grid array 44 enables multiple electronic components to be stacked on circuit board 4. The particular details of double-sided land grid array 44 and the connection to flex cable 38 can be found in commonly assigned U.S. patent application entitled "Stacked Multiple Electronic Component Interconnect Structure", Ser. No. 11/938,858 filed Nov. 13, 2007 currently herewith, the contents of which are incorporated herein by reference in their entirety.

As further shown in FIG. 1, three dimensional die configuration 2 includes a third electronic component 62 and a fourth electronic component 65 that are electrically connected to second surface 59 of second substrate member 56. Third and fourth electronic components 62 and 65 are high power electronic components or chips having an output of about 200 watts or more. In any event, in order to provide adequate heat dissipation for three-dimensional die configuration 2, electronic components 62 and 65 are covered by a corresponding thermal interface layer 67 and 68. Each thermal interface layer 67 and 68 provides a thermal dissipation path that allows heat generated by third and fourth electronic components 62 and 65 to pass, via conduction, to a cover member 72. Cover member 72 is also configured to secure third and fourth electronic components 62 and 65 to circuit board 4.

In accordance with the exemplary embodiment shown, cover member 72 is formed from a heat conducting material, such as steel or copper. The heat conducting material, combined with an additional thermal interface layer 80, and a heat sink 84, provide additional heat dissipation. In this manner, heat generated by the operation of third and fourth electronic components 62 and 65 is conducted away from three-dimensional die configuration 2 allowing multiple electronic components to be placed in a footprint, or on an area of circuit board 2, previously occupied by only a single electronic component. With this configuration, the overall number of electronic components mounted to circuit board 4 can be increased while simultaneously, shrinking the overall size of the circuit board in order to accommodate smaller more compact electronic devices. It should be appreciated at this point that while the first and second electronic components are shown mounted within a cavity formed in the circuit board and surrounded by a thermal interface material, the electronic components can alternatively be mounted to an opposing side of the circuit board with the first substrate member providing an interface to an additional three dimensional stackable die configuration.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

The invention claimed is:

1. A three-dimensional die configuration for mounting electronic components to a circuit board, the three-dimensional die configuration comprising:

a circuit board having at least one cavity including a thermal interface material;

a first electronic component located in the at least one cavity;

a first substrate member located in the at least one cavity, the first substrate member including a first surface electrically connected to the first electronic component, and a second surface;

a double-sided land grid array having a first surface electrically connected to the second surface of the first substrate member, and a second surface;

a second substrate member having a first surface electrically connected to the second surface of the double-sided land grid array, and a second surface;

a second electronic component electrically connected to the second surface of the second substrate member;

a thermal interface member abutting the second electronic component; and a cap member mounted to the second electronic component and the thermal interface member, the resulting three-dimensional die configuration providing a multiple electronic component mounting arrangement having a footprint of a single electronic component.

2. The three-dimensional die configuration according to claim 1, wherein the second electronic component is a high power electronic chip having an output of about 200 watts and the first electronic component is a low power electronic chip having an output of about 50 watts.

3. The three-dimensional die configuration according to claim 2, further comprising:

another thermal interface member mounted to the cap member; and a heat sink mounted to the another thermal interface member, the heat sink providing heat dissipation for the high power electronic chip.

4. The three-dimensional die configuration according to claim 1, further comprising:

a flex cable positioned between the double sided land grid array and one of the first and second substrate members, the flex cable including a plurality of conductors that provide an input and output (I/O) interface between at least one of the first and second electronic components and the circuit board.

5. The three-dimensional die configuration according to claim 1, further comprising:

a plurality of vias formed in the circuit board at the at least one cavity, the plurality of vias providing a heat dissipation path for the first electronic component.

* * * * *